United States Patent [19]

Maxwell

[11] Patent Number: 4,973,046

[45] Date of Patent: Nov. 27, 1990

[54] ADJUSTABLE THERAPEUTIC EXERCISER FOR LOWER HUMAN EXTREMITIES

[76] Inventor: Harold M. Maxwell, 1902 Missoula Ave., Missoula, Mont. 59802

[21] Appl. No.: 348,880

[22] Filed: May 8, 1989

[51] Int. Cl.[5] ..... A63B 23/04; A63B 69/16; A63B 21/00

[52] U.S. Cl. ..... 272/73; 272/96; 272/129; 128/25 R; 74/594.7

[58] Field of Search ..... 272/73, 93, 94, 96, 272/97, 129, 134, 144, 145, DIG. 4; 128/25 R, 25 B; 180/220; 280/200, 214, 251, 255, 286, 259, 287, 291, 294; 74/594.1–594.7, 564

[56] References Cited

U.S. PATENT DOCUMENTS

| | | | |
|---|---|---|---|
| 2,202,187 | 5/1940 | Chalette | 128/25 R |
| 2,784,591 | 3/1957 | Shoor | 272/73 |
| 3,216,722 | 11/1965 | Odom | 272/73 |
| 3,848,870 | 11/1974 | Craig | 272/73 X |
| 4,252,312 | 2/1981 | Dehan | 272/97 |
| 4,262,902 | 4/1981 | Dranselka | 272/73 X |
| 4,417,745 | 11/1983 | Shomo | 74/594.7 X |
| 4,478,213 | 10/1984 | Redding | 128/25 R |
| 4,842,265 | 6/1989 | Kirk | 128/25 B |

*Primary Examiner*—Richard J. Apley
*Assistant Examiner*—Joe H. Cheng

[57] ABSTRACT

An exercise device for active or passive therapeutic exercise of human lower extremities provides a portable base structure supporting a housing that journals a laterally similar adjustable pedal crank rotatably carrying pedals on its outer arms. Motor and drive mechanism carried by the housing power the pedal crank for rotary motion and a brake structure selectively restrains its motion. The housing is adjustably positionable relative the base about three perpendicular intersecting axes and each of the laterally opposed pedal crank arms are compound elements interconnected by adjustment structures allowing positioning of each of three elements forming each pedal crank arm about two mutually perpendicularly axes. Pedal structures, adjustable for foot size, are rotatably mounted on the opposed lateral elements of the pedal crank. Each pedal structure mounts a pedal plate for universally adjustable motion relative to the pedal crank to adjust the plane of contact of a user's foot therewith.

4 Claims, 2 Drawing Sheets

ADJUSTABLE THERAPEUTIC EXERCISER FOR LOWER HUMAN EXTREMITIES

BACKGROUND OF INVENTION

Related Applications

There are no applications related hereto heretofore filed in this or any foreign country.

FIELD OF INVENTION

My invention relates generally to therapeutic exercise devices for passive or active exercise of the lower human extremities and more particularly to such a device that is portable and has opposed pedals that are universally adjustable in both position and motion to accomplish any desired therapeutic motion.

BACKGROUND AND DESCRIPTION OF PRIOR ART

In providing physical therapeutic services for the lower human extremities, it is oftentimes necessary to use either active or passive exercise of various sorts and responsive to this need, many and various mechanical devices have heretofore become known to provide or aid in providing such exercise. One type of such device provides a bicycle-like pedal crank which may be variously mounted, positioned, and moved relative a supporting base for use. My invention provides a new, novel and improved mechanism of this class.

In using such exercise mechanisms for rehabilitative and therapeutic activity, it often is necessary to finely adjust and regulate in three dimensional space the positions of pedals that carry a patient's feet. Known devices have heretofore regulated this positioning to some degree, but none have provided a universality of adjustment required for all therapeutic use. The instant invention differs from the prior art by providing a particular portable, universally adjustable exercise device for this purpose, while yet preserving traditional amenities heretofore common to such exercisers. My invention provides a base plate supporting a housing at a spaced distance thereabove by articulating linkage that allows motion of the housing relative to the base plate in three perpendicular planes. The housing journals a traditionally shaped bicycle type pedal crank of a compound nature that allows motion of each of its three-arm elements relative to the adjoining element about two perpendicular axes, so that the distance between pedals, their angular relationship with each other and their throw may all be adjustably regulated to a fine degree.

Commonly in known exercisers of the instant class, pedal structures have merely provided rigid plate-like elements without means of fastening a patient's feet thereto. To properly exercise the feet and legs of a user, however, it is often necessary to regulate the pedal size to fit a patient's foot and adjust the plane of pedal contact with a patient's foot in an angulated fashion relative to a pedal's rotary axis. Prior art devices generally have not accomplished this. In contradistinction my pedal structures provide compound pedal plates with foot clamps that communicate by a ball-type mounting structure for angular motion in three perpendicular planes relative to the pedal crank structure carrying them. This linkage allows angulation of the principal plane between the foot of a user and its associated pedal through either positive or negative angles in both lateral and medial directions relative to a user.

Many bicycle pedal-type exercise devices of the past have provided fairly massive and extensive mounting structures which commonly made provision for supporting a patient thereon, ordinarily in a sitting position, for use. My invention in contradistinction normally will be used by a patient in a supine, or substantially supine, position on a floor, bed, couch or some similar associated supportative structure not provided directly by the exerciser. This function is accomplished by my spacedly related mounting plate and housing structure, both of which are of small size and relatively adjustable positioning, so that the mounting plate may be positionally maintained on an auxiliary support, with the exercise device and patient maintained in operative positions relative to each other while both are supported by the independent auxiliary supporting structure. My device may also be used by a patient seated on some auxiliary supportative device, such as a stool or chair, positioned adjacent my exerciser. This type of positioning and support is allowed only by the relatively small base plate and a housing journaling the pedal mechanism at a spaced distance allow the base plate to be mounted on independent supporting structure.

While providing these novel features, my invention also provides the traditional features and functions that have heretofore been provided in such exercising devices, such as adjustable braking for active operation of the device and adjustable speeds and reversible motion for its passive operation.

My invention resides not in any one of these features per se, but rather in the synergistic combination of all of its structures to give rise to the particular functions necessarily flowing therefrom, as herein specified and claimed.

SUMMARY OF INVENTION

My invention generally provides a base plate mounting a housing at a spaced distance thereabove by adjustably articulating linkage that allows relative motion of these elements in three mutually perpendicular planes. The housing journals a compound bicycle pedal crank and associated adjustable braking and powering means. The compound pedal crank provides a central shaft, extending laterally from its journaling in the housing, carrying "L" shaped pedal crank arms which journal pedals in their lateralmost portions. Each element of the pedal crank arms is joined by connecting means that allow adjustment of one element in two perpendicular planes relative to a second element supporting it. Pedal structures, journaled by each lateral end of the pedal crank, are of a compound nature providing sizably adjustable pedal plates joined by ball-type articulating linkage to journals carried on the pedal crank to allow adjustable positioning of the pedal in angulated fashion relative to the pedal crank. Adjustable clamps and in maintaining a patient's feet on the pedal plates and fastening means are provided for releasably positioning the mounting plate on a supporting structure.

In creating such a device, it is:

A principal object of my invention to provide a bicycle pedal-type exercise device that is universally finely adjustable to serve as either an active or passive therapeutic exerciser for the lower human extremities.

A further object of my invention to provide such a device that has a supportative base carrying at a spaced distance thereabove a housing journaling a pedal crank structure with articulating linkage connecting the housing and base to allow adjustable positioning of the housing relative the base in three perpendicular directions.

A still further object of my invention to provide a traditionally configured pedal crank of a compound nature having articulately interconnected elements that are adjustably positionable in two perpendicular directions relative to each other.

A still further object of my invention to provide such a device that has compound pedal structures connected by articulating linkage to pedal crank journals to allow both rotary motion and universal angulated positioning relative to the pedal crank.

A still further object of my invention to provide such an exercise device that may be operated by a user supported on an auxiliary structure in either a supine or seated position.

A further object of my invention to provide such a device that is of new and novel design, of rugged and durable nature, of simple and economic manufacture and otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being illustrated in the accompanying drawings, as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 1:
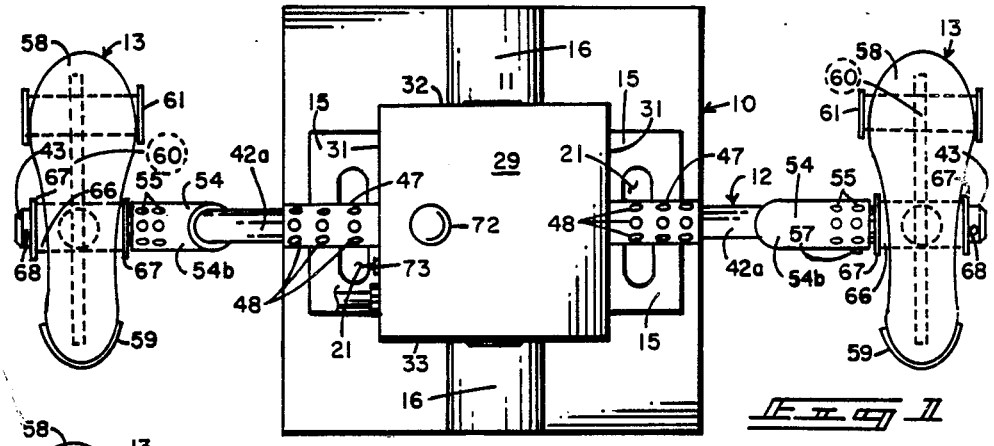
FIG. 1 is an orthographic top view of my exerciser showing the pedal crank in a vertical position.
Figure 2:
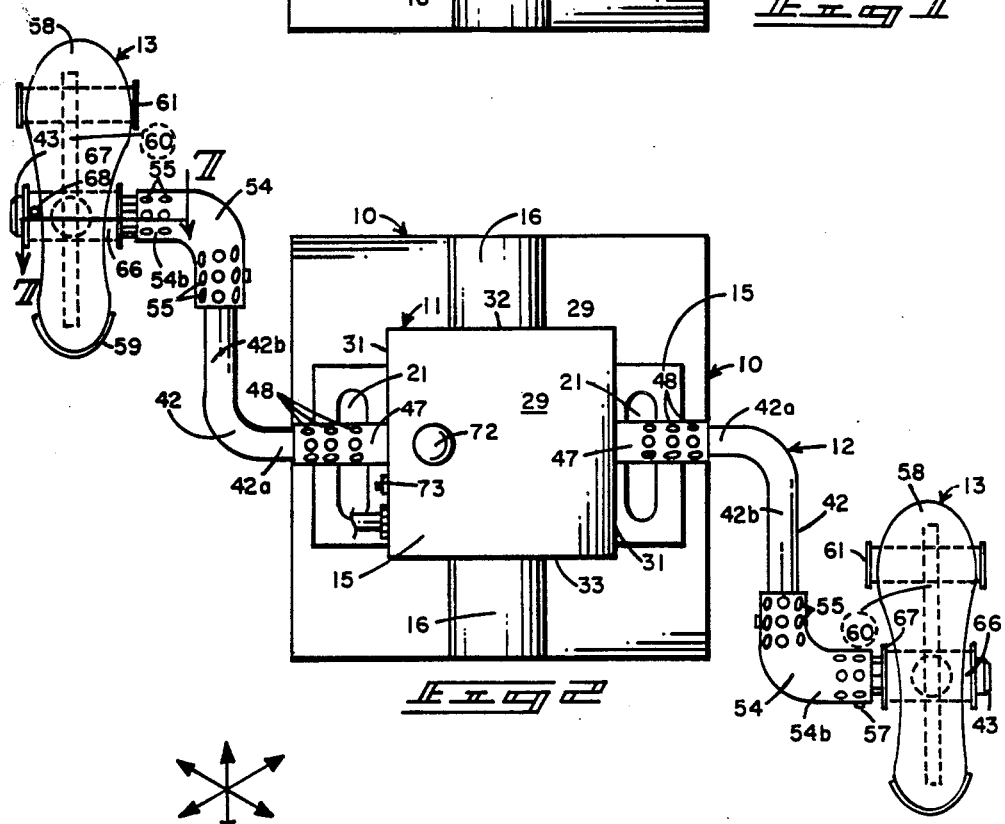
FIG. 2 is a view similar to FIG. 1, but with the pedal crank rotated ninety degrees.

My invention generally comprises base structure 10 carrying spacedly thereabove housing 11 which in turn journals pedal crank 12 for rotary motion of paired opposed pedal structures 13, as determined by motion regulating mechanism 14 carried within the housing.

Figure 4:
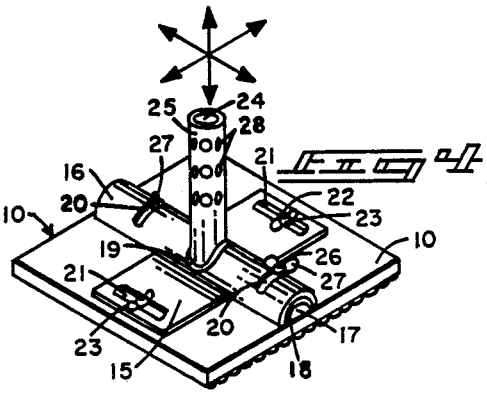
FIG. 4 is an isometric view of the base plate and adjustable linkage interconnecting it with the pedal crank housing thereabove.

Base structure 10, especially as seen in FIG. 4, provides flat rigid base plate 15 having an upraised medial linear portion 16 defining half cylindrical channel 17 to accept mounting tube 18 in a pivotal fashion therein. The medial raised portion 16 defines central slot-like orifice 19 to accept an upwardly extending fastening tube therethrough and allow its lateral pivotal motion therein and two circumferentially extending elongate slots 20, inwardly adjacent each end part, to accept fastening studs carried by mounting tube 18. The side portions of base plate 15, spacedly inwardly adjacent the lateral edges of that plate, define elongate fastening slots 21 extending substantially parallel to the raised medial portion 16 of the base plate. These fastening slots accept fastening studs 22 with wing nuts 23 threadedly engaged thereon to releasably fasten the base plate structure to a primary support therebeneath, but yet allow limited adjustable positioning in a direction parallel to raised medial portion 16.

Elongate mounting tube 18, in the form of an elongate portion of a cylindrical surface, is pivotally carried in channel 17 defined by the base structure. The mounting tube 18 carries in its medial part structurally joined adjustment tube 25 extending perpendicularly upwardly through orifice 19 defined in the base plate. Mounting tube 18 structurally carries normally projecting fastening studs 26 so oriented and positioned as to fit within slots 20 defined in raised medial portion 16 of the base plate and extend therethrough. Each stud 26 threadedly carries wing nut 27 in its upper portion, above raised medial portion 16 of the base plate, to allow adjustable angular positioning of mounting tube 18 relative to the base plate. Adjustment tube 25 defines a central channel 24 and a plurality of fastening holes 28, spaced both radially and axially and extending therethrough, as shown in FIG. 4.

Housing 11 is a peripherally defined box-like member formed by structurally interconnected top 29, bottom 30, similar sides 31, front 32 and back 33. Bottom 30 carries perpendicularly depending support tube 34 having a length and diameter adapted to slidably fit within channel 24 of adjustment tube 25 carried by the base plate structure. This support tube 34 in its lower end portion carries fastening structure having outwardly biased fastening pin 36 extendable through one of the adjustment holes 28 defined in adjustment tube 25. The detailed nature of this fastening structure is the same as that used in the pedal crank to releasably interconnect its element and is specified in detail hereinafter. Plural filets 37 extend between housing bottom 30 and support tube 34 to provide additional support and rigidity for the structures in the area of their communication.

Top 29 of the housing defines brake cord hole 38 to allow the passage of a brake control cable therethrough. Sides 31 of the housing each define paired opposed pedal crank holes 39 in their medial portions to allow the passage of the pedal crank shaft therethrough. Bearings 40 are carried on the inner surface of each side 31, inwardly adjacent pedal crank holes 39, to journal the medial portion of the pedal crank shaft passing therethrough.

Figure 8:
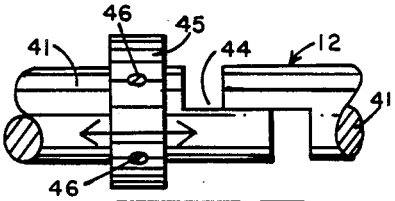
FIG. 8 is an enlarged partial, cut-away and expanded view of the structure interconnecting the medial portions of the pedal crank.

Pedal crank 12 provides a traditional bicycle type pedal crank structure with medial compound shaft 41 carrying similar perpendicularly extending offset shafts 42 at each end to extend in opposite directions. The offset shafts 42 in turn each carry perpendicularly extending pedal shafts 43 extending laterally outwardly, parallel to medial shaft 41. Medial shaft 41 is releasably interconnected in its medial portion for ease of manufacture and assemblage, in the instance illustrated in FIG. 8 by offset joint 44 having annular sleeve 45 slidably positionable thereover where it is releasably retained by set screws 46 extending through the sleeve.

Figure 3:
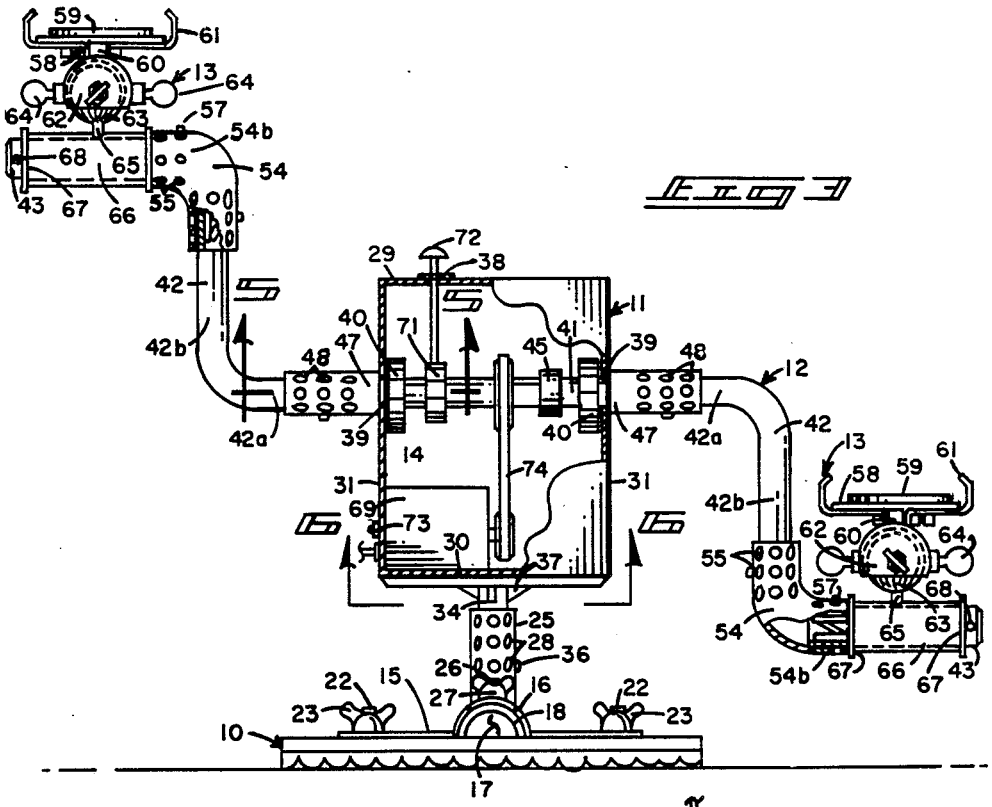
FIG. 3 is an orthographic, partially cutaway, side view of the exerciser of FIG. 1, showing various parts of my invention, their configuration and relationship from this aspect.

The medial shaft in the instance illustrated is a rod-like element carrying similar laterally extending tubular fastening sleeves 47 structurally interconnected at each lateral end portion to serve as thrust bearings to positionally maintain the medial shaft from axial displacement relative to housing 11. Each fastening sleeve 47 defines a plurality of axially and radially spaced fastening pin holes 48 in its lateral portion, as shown particularly in FIG. 3.

Figure 5:
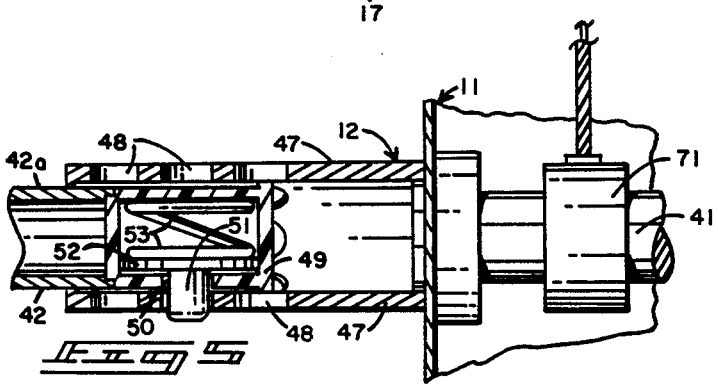
FIG. 5 is an enlarged partial cross-sectional view through the adjustable fastening mechanism interconnecting the medial pedal crank elements, taken on the line 5—5 of FIG. 3 in the direction indicated by the arrows thereon.
Figure 6:
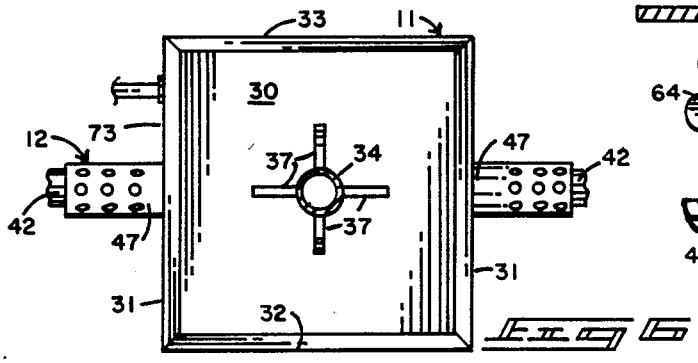
FIG. 6 is an orthographic bottom view, looking upwardly at the housing structure, taken on the line 6—6 of FIG. 3 in the direction indicated by the arrows thereon.
Figure 7:
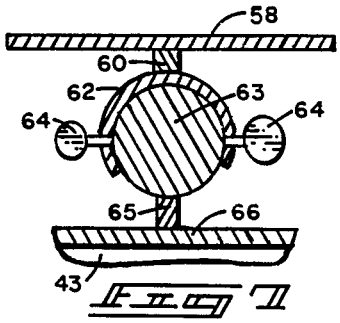
FIG. 7 is a somewhat enlarged cross-sectional view through one of the pedal structures, taken on the line 7—7 on FIG. 2 in the direction indicated by the arrows thereon, to show details of the articulating linkage mounting the pedal plate on its journal.

Offset shafts 42 are "L" shaped rod-like elements having shaft arm 42*a* extending perpendicularly to offset arm 42*b*. As shown in structural detail in the enlarged cross-sectional view of FIG. 5, each end of lateral crank shaft 42 structurally carries a fastening element providing peripherally defined cylindrical casement 49 defining fastening pin hole 50. Within the channel defined by casement 49, fastening pin 51 is carried by base 52 which is biased to a radially outward position by compression spring 53, but manually movable against the bias so that the outer end portion of pin 51 does not extend beyond the outer surface of the orifice defining fastening pin hole 50. Preferably for ease of operation, pin 51 has chamfered end portion to allow it to be more readily moved and fit within fastening holes. The external diameter of casement 49 is of substantially the same diameter as the channel defined by fastening sleeve 47 so that the fastening structure may fit within that sleeve, as illustrated in FIG. 5, with pin 51 extending through one of the fastening pin holes 48 defined in the fastening sleeve to releasably fasten the fastening member within the fastening sleeve.

The outer end portion of each offset shaft 42 carries fastening sleeve 54 which is an "L" shaped tubular elbow having perpendicularly extending arms. Each of the fastening arms defines a plurality of axially and radially spaced fastening holes 55. Each fastening sleeve 54 defines an internal channel that is configured to slidably receive the fastening end portion of one offset shaft 42 and one pedal shaft 43. Pedal leg 54*b* of the fastening sleeve releasably and adjustably carries pedal shaft 43 by means of a pedal shaft fastener structurally carried by the inner end portion of that pedal shaft. Each pedal shaft fastener provides fastening pin 57 engageable in one of the fastening holes 55 defined in the fastening sleeves for releasable positional maintenance and is of a configuration to fit within the channel defined by the fastening elbow. The pedal shaft 43 is preferably of a length somewhat greater than the width of a pedal to be carried thereby.

Each pedal structure 13 provides pedal plate 58, peripherally configured somewhat in the shape of a foot, with an upstanding rim 59 about at least a portion of its periphery to aid in maintaining a user's foot thereon. Each pedal plate 58 is structurally carried by underlying medial support beam 60. A "roller skate" type adjustable foot clamp 61 is carried by the forepart of beam 60 and in underlying relationship to pedal plate 58 to aid releasable maintenance of feet of different sizes upon that foot plate.

Each medial support beam 60 is carried in its middle part by an adjustment clamp. The support beam communicates with the central portion of adjustment clamp hemispherical outer shell 62 which is movably carried upon ball 63 for universal motion. A plurality of thumbscrews 64, preferably three in symmetrical spaced array, threadedly communicate through the adjustment clamp outer shell 62 to adjustably positionally maintain the outer shell relative to the inner shell. Preferably the outer shell 62 covers somewhat more than a hemisphere of the ball 63 carrying it to maintain the two elements in interconnected adjacency according to the structural configuration of such devices heretofore known.

The lower portion of ball 63 structurally carries support standard 65 depending to structural communication with cylindrical journal 66 which is rotatably carried upon pedal shaft 43. The journal 66 is operatively maintained on the pedal shaft 43 against axial displacement by washers 67 at each journal end with spring biased pins 68 carried by the pedal shaft in its outer end part to positionally maintain the outer washer. This structure provides ordinary rotary motion of the pedal structures upon their supporting pedal shafts, but yet allows adjustment of the pedals for different sized feet and continuous angular adjustment of each foot plate in three perpendicular directions relative to its journal.

Motion regulating mechanism 14 provides electrically powered motor 69, operatively supported within the chamber defined by housing 11, to transmit rotary motive power by belt and pulley linkage 74 to medial shaft 41. Preferably electric motor 69 is of a type that provides adjustably variable speed as controlled by speed knob 73 carried externally of housing 11. Friction brake 71 is structurally carried by one pedal shaft bearing 40 to extend about medial shaft 41 and, by operation of regulating knob 72 cause adjustable braking friction on medial shaft 41. None of this motion regulating mechanism is new per se, all has been known in the prior art and none is therefore described in detail.

Having thusly described the structure of my invention, its operation may be understood.

Firstly, an exerciser is formed according to the foregoing specification. Base 10 is fastened to some appropriate primary support structure (not shown) preferably by placing base plate 15 to position studs 22 carried by the primary support structure within fastening slots 21 and thereafter engaging wing nuts 23 to releasably fasten the base plate to the support structure. Commonly the primary support will be a floor of a structure, a flat board, or similar slab-like structure of some substantial area, especially one on which a patient may sit on a separate chair or stool or may lie to use the exerciser. The exerciser is then adjusted to accommodate the particular needs of an individual patient.

The position of the housing 11 carrying the pedal crank is adjusted relative to the base plate 15 firstly, for gross positioning by placing the patient in an appropriate position relative to the base plate and secondly, for fine adjustment by appropriately moving the base plate relative to its principal support by loosening nuts 23 on studs 22, properly positioning the base plate, and retightening the stud-nut combinations after proper positioning is obtained. The housing 11 may be moved to adjust for lateral angulation by means of stud-nut combinations 26, 27. The housing 11 may be adjusted in its vertical position and its azimuthal angulation about support tube 34 by adjustably positioning the support tube fastening structure in adjustment tube 25 carried by the base plate.

In adjusting the pedal crank structure, both the distance between pedals 13 and their angular relationship with each other may be adjusted by manipulation of fasteners carried by lateral crank shafts 42 in fastening sleeves 47. The throw of the pedals and the distance between them may be adjusted by manipulation of the pedal shaft fastener and crank shaft fastener in fastening elbow 54. The lateral angular relationship of each pedal plate 58 and the pedal shaft 43 supporting it may be regulated by loosening thumbscrews 64 of the adjustment clamp linkage, manually adjusting the two clamp elements, and retightening those thumbscrews.

Once the exerciser has been properly adjusted, the feet of a patient are placed on pedal plates 58, and the exerciser selectively operated. A patient's feet may be supported or maintained on the pedal plates by means of fasteners 61 or by traditional strapping or similar devices. It is to be noted that the exerciser may be used actively when activated by motor 69 to cause forceful exercise of the limbs of a user or it may be used passively when operated by the user himself, especially with motion restraint imposed by the braking mechanism.

From the foregoing description, it is to be particularly noted that the multiple adjustments provided by my exercise device allow relative positioning of the pedal plates in any position that may be desired for physical therapy, either actively or passively provided, and the particular adjustment structures involved allow a fine determination and regulation of this positioning.

It is further to be noted that my exerciser might readily be used by a supine patient lying on a horizontal surface, such as a floor, bed or couch, especially when the exerciser is carried on a board-like support structure on which the patient may lie; but yet it also may be used by fastening it to a floor or board-like structure and positioning a patient in a seated fashion on a separate chair, stool or similar sitting support so that the patient may use the device in the traditional positioning and fashion of a bicycle. In fact if so desired, a patient may be seated on an appropriate support vertically above housing 11 so that the action of the device would be substantially identical to that of a bicycle.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. A mechanism for actively and passively exercising the lower extremities of a person, comprising in combination:

a base having a first means for attaching a primary support structure and for adjustable positioning in at least one plane relative to said primary support structure;

a housing carried spacedly above the base by articulating linkage providing a second means for adjusting motion of the housing in three perpendicular directions relative to the base;

a compound pedal crank journaled in the housing and extending laterally on both sides thereof, said pedal crank having a first medial shaft portion, a pair of second lateral shaft portions, wherein one end of each second lateral shaft portion extends perpendicularly at each end of the first medial shaft portion, and a pair of third pedal shaft portions, wherein one end of each third pedal shaft portion extends perpendicularly and outwardly from the other end of the second lateral shaft portion and parallel to the first medial shaft portion, each of said second lateral shaft portions and third pedal shaft portions being adjustably positionable for motion in two perpendicular directions relative to the compound pedal crank;

a pair of pedal structures, wherein each of said pedal structures is carried by each of the third pedal shaft portions for rotary motion relative thereto, each of said pedal structures having a pedal adjustment means for selectively determining a pedal angle in three perpendicular planes relatively to the third pedal shaft portion supporting it; and pedal crank motion regulating mechanism including means of rotating the first medial shaft portion and brake means for adjustably limiting the rotary motion of the third pedal shaft portions.

2. The mechanism for actively and passively exercising the lower extremities of a person of claim 1 further characterized by:

the articulating linkage interconnecting the base and the housing comprising an elongate mounting tube carried in a horizontally orientated channel defined by the base with releasable fastening means to selectively regulate the position of the mounting tube relative to the base and a fastening tube extending substantially perpendicularly upwardly from the mounting tube, through an orifice defined in the base and a spaced distance thereabove, said fastening tube including a medial channel having a plurality of axially and radially spaced holes to accept and releasably fasten a fastening structure carried by a support tube from the bottom of the housing.

3. The mechanism for actively and passively exercising the lower extremities of a person of claim 1 further characterized by the compound pedal crank having:

fastening sleeves at each end of the first medial shaft portion, each of said fastening sleeves defining a plurality of axially and radially spaced holes extending therethrough;

wherein each of the second lateral shaft portions comprising an L-shaped element having fastening means at each end of said second lateral shaft portions with movable, radially outwardly biased pins extending therefrom and a first end of each of said second lateral shaft portions being carried by each of said fastening sleeves of the first medial shaft portion;

fastening elbows having perpendicular legs defining internal channels and a plurality of axially and lineally spaced fastening pin holes extending therethrough, one of said elbows carried on a second outer end of each of said second lateral shaft portions; and wherein each of the third pedal shaft portions having an end fastening means releasably carried in each of the fastening elbows on the second outer ends of each of said second lateral shaft portions.

4. The mechanism for actively and passively exercising the lower extremities of a person of claim 3 further characterized by the pedal adjustment means comprising:

a ball-type linkage being carried by a cylindrical journal rotatably mounted upon the relative third pedal shaft portions, wherein each of said pedal structures have a pedal plate with a rim about part of the pedal plate periphery, said pedal plate being carried by said ball-type linkage for adjusting said pedal angle in said three perpendicular planes.

* * * * *